US007413448B1

(12) United States Patent
Lin et al.

(10) Patent No.: US 7,413,448 B1
(45) Date of Patent: Aug. 19, 2008

(54) CONNECTOR

(75) Inventors: Kuo-Chin Lin, Taipei Hsien (TW); Hsin-Min Chao, Taipei Hsien (TW); Feng Zhu, Taipei Hsien (TW); Hau-Lian Liu, Taipei Hsien (TW)

(73) Assignee: Cheng Uei Precision Industry Co., Ltd, Taipei Hsien (TW)

( * ) Notice: Subject to any disclaimer, the term of this patent is extended or adjusted under 35 U.S.C. 154(b) by 0 days.

(21) Appl. No.: 11/757,268

(22) Filed: Jun. 1, 2007

(51) Int. Cl.
*H01R 12/00* (2006.01)

(52) U.S. Cl. ..... 439/79; 439/108; 439/607; 439/541.5; 439/567; 439/265

(58) Field of Classification Search ..... 439/79, 439/108, 607–608, 541.5, 567, 263, 265
See application file for complete search history.

(56) References Cited

U.S. PATENT DOCUMENTS 4,511,659 A * 4/1985 Matson ..... 205/780.5
6,736,676 B2 * 5/2004 Zhang et al. ..... 439/607
6,767,251 B2 * 7/2004 Yu et al. ..... 439/607
7,264,507 B2 * 9/2007 Beckman et al. ..... 439/607

* cited by examiner

*Primary Examiner*—Truc T Nguyen
(74) *Attorney, Agent, or Firm*—WPAT, PC; Anthony King

(57) ABSTRACT

A connector includes an insulating body, terminals received in the insulating body, an electrical shell covering the insulating body and two welding pieces. The electrical shell includes a top board, a bottom board and two side boards. Each of the side boards defines a first gap at the upside of the back end. Two sides of the top board protrude to form a first withstanding piece. A second withstanding piece extends outwards from a lower portion of the side board. Each of the welding pieces includes a welding part. The front end of the welding part extends outwards to form a connecting part. The top of the back of the welding part defines a second gap, the front of the second gap forms a block wall. The back of the welding part extends inwards to form a raised lump under the second gap. The back of the welding part extends downwards to form a limitative lump. The first withstanding piece places in the second gap and is against the block wall. The second withstanding piece is against the front wall of the limitative lump. The raised lump is placed at the first gap and supported by the bottom wall of the first gap.

6 Claims, 4 Drawing Sheets

CONNECTOR

BACKGROUND OF THE INVENTION

1. Field of the Invention

The present invention relates to a connector, and more particularly to a connector which can connect with the electric product firmly.

2. The Related Art

As electronics industry develops, connectors are widely used in the electric products. The traditional connector includes an electrical shell, an insulating body and terminals. The insulating body is received in the electrical shell. The terminals are received in the insulating body and are used to transmit signal. The insulating body usually has fixing pillars extending downwards from the bottom thereof for being connected with a PCB.

When the traditional connector is connected with the electric product, the fixing pillars and the terminals are welded on the PCB. However, because of the manpower for inserting and pulling out, the terminals and the fixing pillars can not connect with the PCB firmly, therefore, the connector is placed in the electric product unfirmly.

SUMMARY OF THE INVENTION

Accordingly, an object of the present invention is to provide a connector comprising an insulating body, terminals received in the insulating body, an electrical shell and two welding pieces. The electrical shell includes a top board, a bottom board and a pair of side boards, the top board, the bottom board and the two side boards form a receiving space for receiving the insulating body. Each of the side boards defines a first gap through the top board at the upside of the back end. Two sides of the top board protrude to form a first withstanding piece extending out from the first gap respectively. A second withstanding piece extends outwards from a lower portion of the side board. The second withstanding piece is at the front of the first withstanding pieces. Each of the welding pieces includes a welding part welded on the side board of the electrical shell. The front end of the welding part extends outwards to form a connecting part, the front surface of the connecting part defines a screw hole. The top of the back of the welding part defines a second gap, the front of the second gap forms a block wall. The back of the welding part extends towards the opposite direction of the connecting part to form a raised lump under the second gap. The back of the welding part extends downwards to form a limitative lump. The first withstanding piece places in the second gap and is against the block wall. The second withstanding piece is against the front wall of the limitative lump. The raised lump is placed at the first gap and supported by the bottom wall of the first gap.

As described above, by adding the welding pieces, the connector can connect with the electric product more firmly. The cooperation of the first withstanding piece and the second gap, the second withstanding piece and the limitative lump, the raised lump and the first gap ensures the welding piece placing on the side board of the electrical shell more accurately and quickly.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
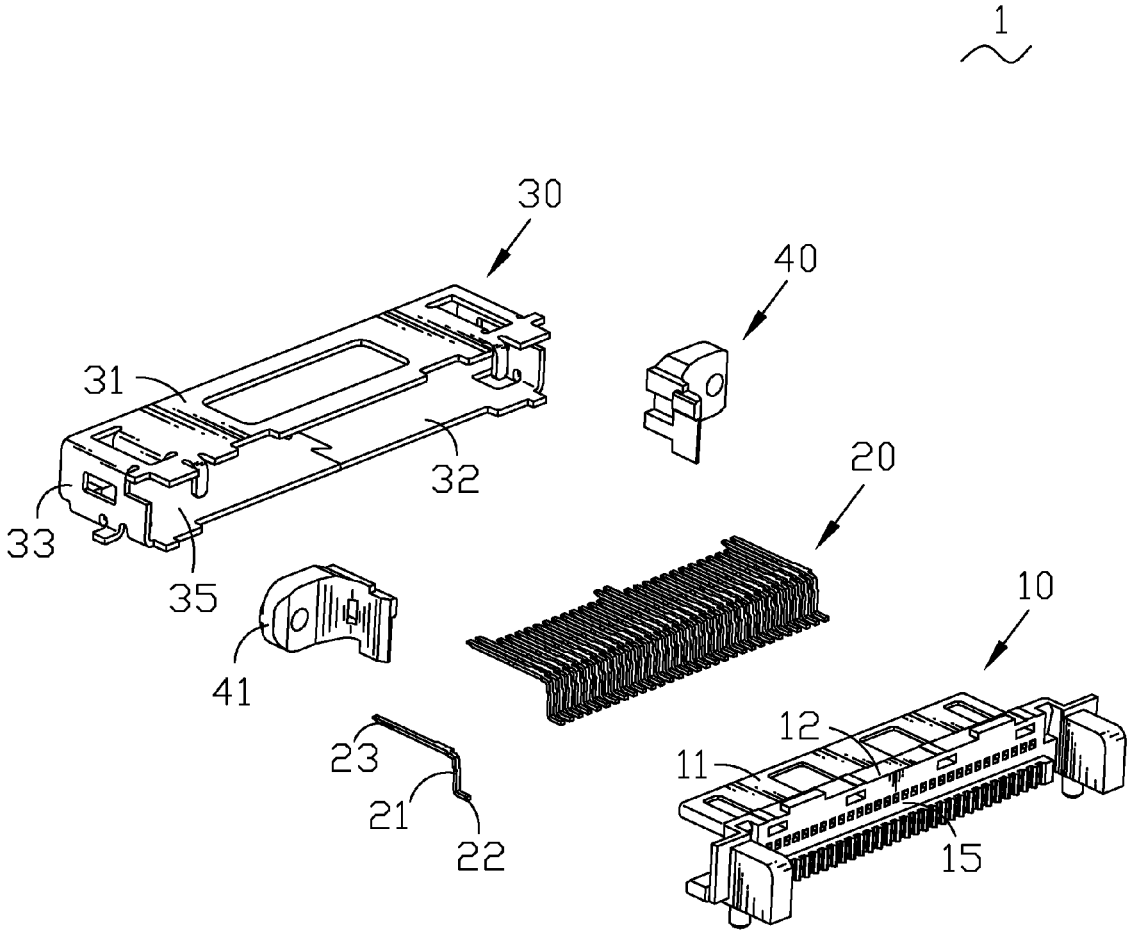
FIG. 1 is an exploded view of a connector of the present invention.

Please referring to FIG. 1, a connector 1 includes an insulating body 10, terminals 20, an electrical shell 30 and a screwing structure 40. The terminal 20 is received in the insulating body 10. The electrical shell 30 covers the insulating body 10. The screwing structure 40 includes two welding pieces 41 which are connected to the two sides of the insulating body 10 respectively.

Figure 3:
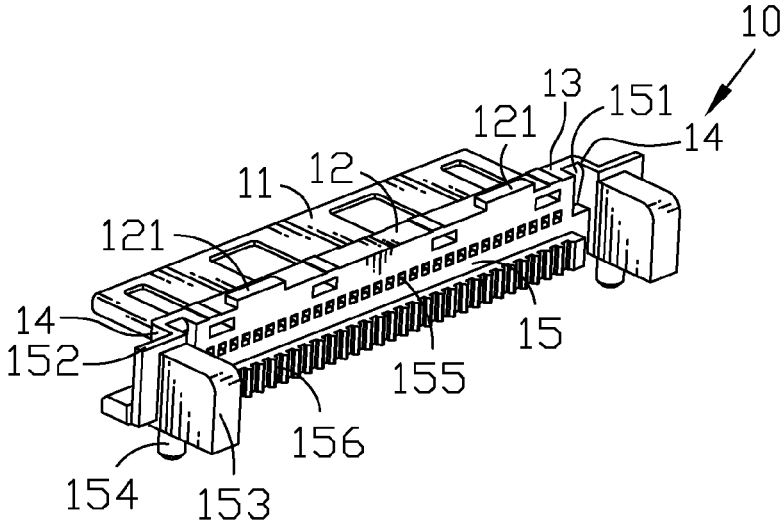
FIG. 3 is a perspective view of an insulating body of the connector.

Referring to FIG. 3, the insulating body 10 includes a base 13 extending transversely and a mating portion 11 extending from the front of the base 13. The base 13 has a top wall 12, two side walls 14 and a back wall 15. The opposite sides of the top wall 12 extend upwards to form an inserting lump 121 respectively. The outer surface of the back wall 15 defines two connecting troughs 151 through the top wall 12 at the two sides. The back of the side wall 14 extends outwards to form a withstanding part 152. The withstanding part 152 extends backwards to form a contacting part 153. The bottom of the contacting part 153 extends downwards to form a fixing pillar 154 for being connected to a PCB (not shown). The out surface of the back wall 15 defines inserting holes 155 for the insertion of the terminals 20 and fillisters 156. The mating portion 11 defines passageways (not shown) communicating with the inserting holes 155 for receiving the corresponding terminals 20.

Figure 6:
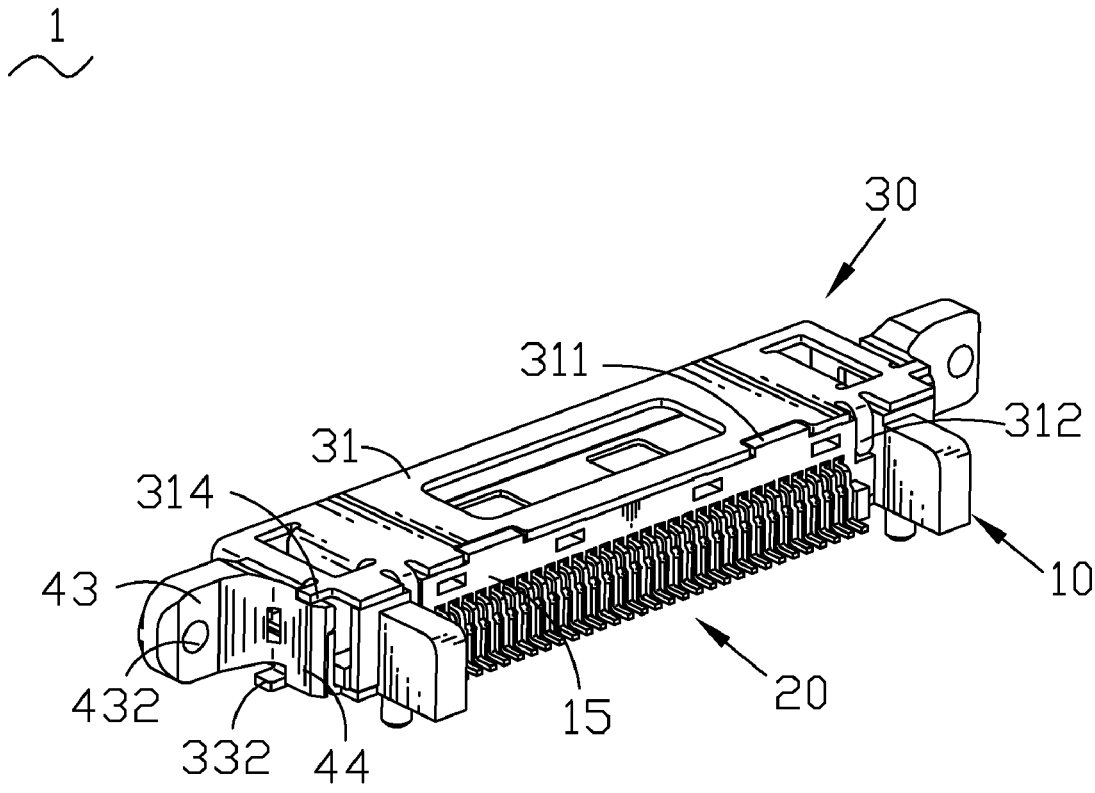
FIG. 6 is a perspective view of the connector of the present invention.

The terminal 20 includes a base part 21, a closing part 22 and an inserting part 23. The base part 21 extends downwards and bends backwards to form the closing part 22. The base part 21 extends forwards to form the inserting part 23. As shown in FIG. 6, a lower portion of the base part 21 places in the fillister. The closing part 22 is welded on the PCB. The inserting part 23 is received in the inserting hole 155 and the passageway of the insulating body 10

Figure 2:
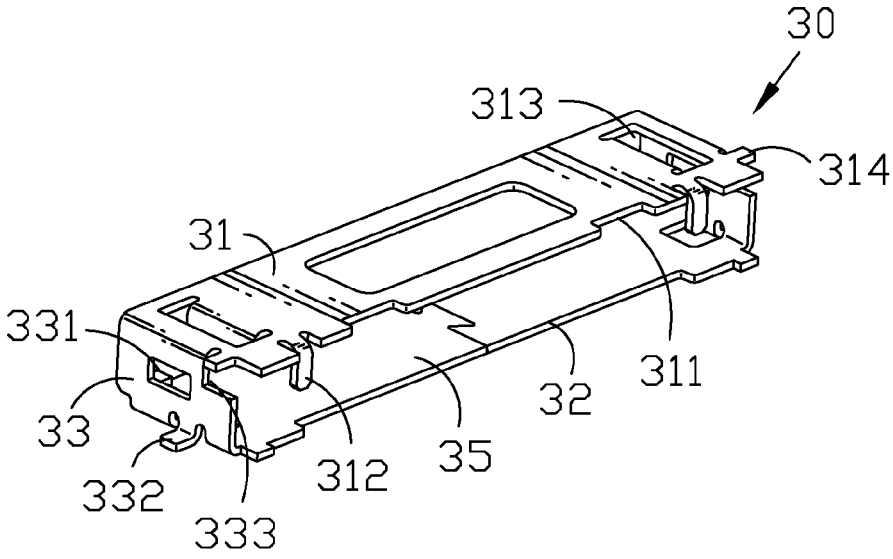
FIG. 2 is a perspective view of an electrical shell of the connector.

Please referring to FIG. 2, the electrical shell 30 includes a top board 31, a bottom board 32 and a pair of side boards 33. The top board 31, the bottom board 32 and the two side boards 33 form a receiving space 35. The top board 31 defines a pair of withstanding troughs 311 at the two sides of the back end. The withstanding trough 311 is jammed by the inserting lump 121 of the insulating body 10. The top board 31 bends downwards to form a pair of fixing pieces 312 at the outside of the withstanding troughs 311. The fixing piece 312 is jammed into the connecting trough 151 of the insulating body 10. Two opposite sides of the top board 31 define a first opening 313 respectively. The side board 33 defines a first gap 333 at the upside of the back end. The first gap 333 gets through the top board 31. Two opposite sides of the top board 31 protrude to form a pair of first withstanding pieces 314 extending out from the first gaps 333. The side board 33 defines a second opening 331 at the front of the first gap 333. A second withstanding piece 332 extends outwards from a lower portion of the side board 33. The second withstanding piece 332 is at the front of the first withstanding pieces 314.

Figure 4:
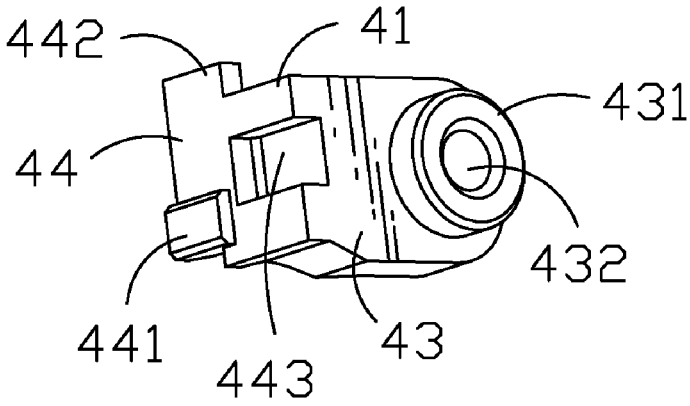
FIG. 4 is a perspective view of a welding piece of the connector.
Figure 5:
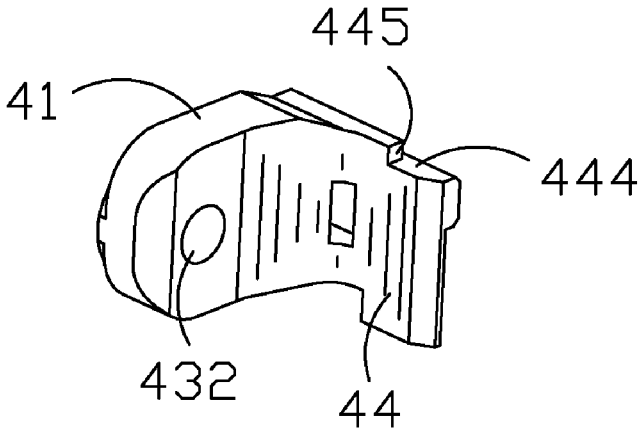
FIG. 5 is another perspective view of the welding piece.

Referring to FIG. 4 and FIG. 5, each welding piece 41 includes a welding part 44 which is used to connect to the side board 33 of the electrical shell 30. The front end of the welding part 44 extends outwards to form a connecting part 43. The inner surface of the welding part 44 defines a third opening 443 communicating with the outside at the front. The third opening 443 communicates with the second opening 331 of the side board 33. The free end of the connecting part 43 is an arc. The front surface of the connecting part 43 extends forwards to form a ring 431. The middle of the ring 431 defines a screw hole 432 through the back surface of the connecting part 43. The top of the back of the welding part 44 defines a second gap 444, the front of the second gap 444 forms a block wall 445. The back of the welding part 44 extends towards the opposite direction of the connecting part 43 to form a raised lump 441 under the second gap 444. The back of the welding part 44 extends downwards to form a limitative lump 442.

Referring to FIG. 3, FIG. 4 and FIG. 6, the electrical shell 30 receives the insulating body 10. The mating portion 11 is inserted into the receiving space 35 of the electrical shell 30. The base 13 is clipped in the back of the receiving space 35. The inserting lumps 121 of the insulating body 10 are jammed into the corresponding withstanding troughs 311 of the electrical shell 30. The fixing pieces 312 of the electrical shell 30 are jammed into the corresponding connecting troughs 151 of the insulating body 10. When the welding piece 41 is connected to the electrical shell 30, the welding part 44 of the welding piece 41 is welded on the outer surface of the side board 33, the first withstanding piece 314 places in the second gap 444 and is against the block wall 445, the second withstanding piece 332 is against the front wall of the limitative lump 442. The raised lump 441 is placed at the first gap 333 and supported by the bottom wall of the first gap 333. Lastly, the connecting part 43 of the welding piece 41 is connected to the electric product by a screw passing through the screw hole 432 and then being inserted into the corresponding place of the electric product.

As described above, by adding the welding pieces 41, the connector 1 can connect with the electric product more firmly. The cooperation of the first withstanding piece 314 and the second gap 444, the second withstanding piece 332 and the limitative lump 442, the raised lump 441 and the first gap 333 ensures the welding piece 41 placing on the side board 33 of the electrical shell 30 more accurately and quickly.

What is claimed is:

1. A connector, comprising:

an insulating body;

terminals, received in the insulating body;

an electrical shell, including a top board, a bottom board and a pair of side boards, the top board, the bottom board and the two side boards forming a receiving space for receiving the insulating body, each of the side boards defining a first gap through the top board at the upside of the back end, two sides of the top board protruding to form a first withstanding piece extending out from the first gap respectively, a second withstanding piece extending outwards from a lower portion of the side board, the second withstanding piece being at the front of the first withstanding pieces; and two welding pieces, each of the welding pieces including a welding part welded on the side board of the electrical shell, the front end of the welding part extending outwards to form a connecting part, the front surface of the connecting part defining a screw hole, the top of the back of the welding part defining a second gap, the front of the second gap forming a block wall, the back of the welding part extending towards the opposite direction of the connecting part to form a raised lump under the second gap, the back of the welding part extending downwards to form a limitative lump;

wherein the first withstanding piece places in the second gap and is against the block wall, the second withstanding piece is against the front wall of the limitative lump, the raised lump is placed at the first gap and supported by the bottom wall of the first gap.

2. The connector as claimed in claim 1, wherein the insulating body includes a base extending transversely and a mating portion extending from the front of the base, the base has a top wall, two side walls and a back wall.

3. The connector as claimed in claim 2, wherein the opposite sides of the top wall extend upwards to form an inserting lump respectively, the top board defines a pair of withstanding troughs at the two sides of the back end, The withstanding trough is jammed by the inserting lump.

4. The connector as claimed in claim 2, wherein the outer surface of the back wall defines two connecting troughs through the top wall at two sides, the top board bends downwards to form a pair of fixing pieces, the fixing piece is jammed into the connecting trough.

5. The connector as claimed in claim 2, wherein the back of the side wall extends outwards to form a withstanding part, the withstanding part extends backwards to form a contacting part, the bottom of the contacting part extends downwards to form a fixing pillar for being connected to a PCB.

6. The connector as claimed in claim 1, wherein the side board defines a second opening at the front of the first gap, the inner surface of the welding part defines a third opening communicating with the outside at the front, the third opening communicates with the second opening of the side board.

* * * * *